US006235992B1

(12) United States Patent
Abisso et al.

(10) Patent No.: US 6,235,992 B1
(45) Date of Patent: May 22, 2001

(54) ELECTRIC DEVICE WITH SILICONE INSULATING FILLER

(75) Inventors: Alberto Abisso, Lecce; Manuela Signorelli, Sotto, both of (IT)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/350,286

(22) Filed: Jul. 9, 1999

(30) Foreign Application Priority Data

Jul. 10, 1998 (EP) ..... 98202327

(51) Int. Cl.[7] ..... H01B 7/00

(52) U.S. Cl. ..... 174/110 S; 174/110 R; 174/44

(58) Field of Search ..... 174/110 R, 111, 174/118, 110 S, 44

(56) References Cited

U.S. PATENT DOCUMENTS 2,739,638 * 3/1956 Lewis et al. ..... 174/110 S

FOREIGN PATENT DOCUMENTS 0 562 778 9/1993 (EP) .

OTHER PUBLICATIONS

Sugiura Tadashi, Patent Abstracts of Japan, "Production of Optical Fiber Composite Insulator." (05264825) Oct. 15, 1993.

* cited by examiner

*Primary Examiner*—Shawn Riley
(74) *Attorney, Agent, or Firm*—Oblon, Spivak, McClelland, Maier & Neustadt, P.C.

(57) ABSTRACT

An electric device for medium and high voltage transmission and/or distribution lines having a free volume V undergoing an electrical stress and including an insulating filler that fills the free volume, wherein the insulating filler includes a compressible silicone-based composition having a volume under normal conditions ranging from 1.01 to 1.2 V at a temperature of 25° C. The silicone-based composition may include hollow compressible plastic microspheres. The silicone-based composition may also include a crosslinkable polyorganosiloxane and an organosilicon crosslinker.

20 Claims, 4 Drawing Sheets

ELECTRIC DEVICE WITH SILICONE INSULATING FILLER

CROSS-REFERENCE TO RELATED APPLICATIONS

This application claims priority from European Application No. EP 98202327.7 filed Jul. 10, 1998.

BACKGROUND OF THE INVENTION

1. Field of the Invention

The present invention relates to an electric device for medium and high voltage transmission and/or distribution lines containing as insulating filler a silicone-based composition having improved chemical-physical characteristics, in particular, dielectric strength and compressibility.

2. Description of the Related Art

It is known that electric devices for medium and high voltage transmission and/or distribution lines, such as circuit breakers, insulated switch-gears, power and distribution transformers, instrument transformers, surge arresters, cable terminations, pole heads, bushings, insulators and similar, generally contain suitable free volumes filled with an insulating filler. In particular, said insulating filler, which can be solid or semisolid, liquid or gaseous, must basically guarantee a desired dielectric strength among the parts of the device having different voltage due to the normal electrical functioning.

At the present state of the art, use of well known insulating fillers for different applications and/or specific needs presents some drawbacks.

For example, when liquid insulating fillers are used, typically dielectric oils, compensating volumes must be employed to counteract effects caused by thermal expansions of insulating liquids; in the case of gaseous insulating fillers, such as sulphur hexafluoride ($SF_6$) or nitrogen and/or their mixtures, systems monitoring the gas pressure as well as gas filling up devices are necessary to keep insulating properties unchanged.

In addition, in both case of gaseous and liquid insulating fillers, special devices and security systems must be used to prevent and/or to detect filler leakages which could cause misfunctioning of the electric device as well as environmental pollution.

This affects the electric devices in terms of structural complexity and also overall reliability of the insulating system.

In some applications, solid or semisolid materials, such as polyurethane, silicone foams or rubbers, are also used as insulating fillers. In particular, such solid fillers give the advantage to prevent leakages from the electric device as well as to eliminate special devices and security systems; but, on the other hand, they present the main problem of requiring accurate process controls to reach a good quality of adhesion to the surrounding parts of the device. As a matter of fact, in the case of defective and non-homogeneous adhesion to the electric device surrounding parts, inceptions of destructive electric discharges may happen due to air filtering; these electric discharges could cause the electric device breakdown.

In order to avoid this drawback, adhesion promoters have to be used and all surfaces must be treated with primers so as to obtain a good and homogeneous filler adhesion; such treatments are expensive and complicated especially in the case of electric devices having complex geometry and in particular when functional elements such as cables, mechanical rods, connections under voltage are present.

Another problem related to the use of known solid or semisolid insulating fillers is due to the intrinsic properties of such materials generally presenting high coefficients of thermal expansion associated to a negligible, like a liquid, compressibility; this fact represents a limit to the applications.

For instance, the use of cross-linked silicone elastomers for electric applications as insulating fillers, is already known. These materials have a thermal expansion coefficient of about $10^3C^{-1}$ and a low compressibility, comparable to the typical value of a liquid; since in these applications the silicon elastomer is inserted in closed spaces and expands because of a possible heating, particurarly in the case of high-voltage applications, damages to the electric device could happen.

SUMMARY OF THE INVENTION

The main task of the present invention is to overcome the above described drawbacks by realising an electric device for medium and high voltage transmission and/or distribution lines, containing as insulating filler a material which, when inserted in a free volume to be filled, could saturate said volume thereby achieving dielectric strength levels necessary to the electric device functioning.

Within the scope of the aforesaid task, another aim of the present invention is to realise an electric device for medium and high voltage transmission and/or distribution lines, comprising an insulating filler having improved compressibility in order to be applicable within a wide functioning temperature range without requiring compensating volumes.

A further aim of the present invention is to realise an electric device for medium and high voltage transmission and/or distribution lines, comprising an insulating filler having an optimum adhesion on the internal surfaces without requiring surface treatments and adhesion promoters.

Yet another aim of the present invention is to realise an electric device for medium and high voltage transmission and/or distribution lines, having an insulating filler material with no filler leakage problems, so as to eliminate all related monitoring and signalling systems normally used in already known devices.

This task, as well as these and other aims which will become apparent in greater detail hereinafter, are achieved by an electric device for medium and high voltage transmission and/or distribution lines having a free volume V undergoing to electrical stress, said volume V being filled with an insulating filler, characterised in that said insulating filler include a compressible silicone-based composition having a volume under normal conditions ranging from 1.01 to 1.2 V, at the temperature of 25° C. Electric devices for medium and high voltage transmission and/or distribution lines are to be considered for voltages of above 1000 Volts. In practice, the free volume V of the electrical device is filled with an extra-volume of a compressible silicon-based composition, said extra-volume ranging from 1.01 and 1.2 V when measured at 25° C.

In particular, such silicone-based composition has a good compressibility thus enabling to compensate possible thermal shrinkage and/or expansions over a wide functioning temperature range without requiring additional compensating volumes. Said compressibility can be advantageously obtained by mean of hollow compressible micro-spheres. Generally said micro-spheres have diameters ranging from 5 $\mu$m to 100 $\mu$m and are made of plastic material; in particular said microspheres are based on organic polymeric material, such as, polyacrylonitrile, polyvinyl chlorides, polyvinyl acetates, polyesters, polycarbonates, polyethylenes, polystyrenes, polymethyl methacrylates, polyvinyl alcohols, ethylcellulose, nitrocellulose, benzylcelloluse, epoxy resins, hydroxypropylmethylcellulose phthalate, copolymers of vinyl chloride and vinyl acetate, copolymers of vinyl acetate and cellulose acetobutyrate, copolymers of styrene and maleic acid, copolymers of acrylonitrile and styrene, copolymers of vinylidene chloride and acrylonitrile and similar substances.

Examples of suitable micro-spheres are those commercially available under the trade mark Dualite® by Pierce and Stephens Corp., and those sold under the trade mark Expancel® by Akzo Nobel.

The silicone-based composition generally comprises the following constituents:

a) a crosslinkable polyorganosiloxane; and, b) an organosilicon crosslinker.

An example of crosslinkable polyorganosiloxane is given by compounds having general formula:

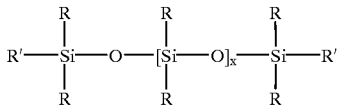

in which R is a monovalent hydrocarbon group having up to 18 carbon atoms, R' is a monovalent hydrocarbon or hydrocarbonoxy group, a hydrogen atom or a hydroxyl group, and x is an integer having a value of from 10 to 1500.

Examples of organosilicon crosslinker can be selected from silanes, low molecular weight organosilicon resins and short chain organosiloxane polymers.

Further characterising features and advantages of the invention will be more clearly from the description of preferred, but not exclusive embodiments of the electric device according to the invention, illustrated by way of non-limiting examples in the accompanying drawings in which:

DESCRIPTION OF THE PREFERRED EMBODIMENTS

Figure 1:
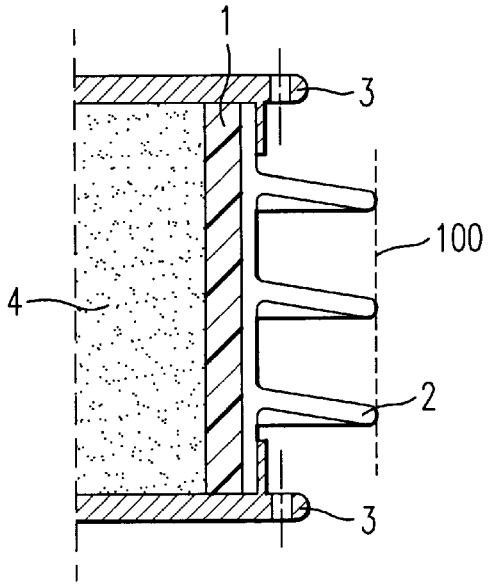
FIG. 1 shows a supporting insulator, according to a first embodiment of the electric device of the present invention.

As illustrated in FIG. 1, the electric device of the present invention is described with particular reference to a supporting insulator; such embodiment has to be considered by way of explanatory and non-limiting example.

As illustrated in FIG. 1, an insulator, generally designated by the reference numeral 100, comprises an insulating tube 1 made of insulating composite material, for instance fiberglass, covered with insulating sheds 2, for example made of silicone rubber; at the ends of the tube 1 two metallic flanges 3 are fixed. When the insulator is under voltage, the two metallic flanges have different electric potential; in order to achieve electric insulation between the two flanges having different voltage thus avoiding dangerous electric discharges, the free volume V inside the tubular case 1, is filled with a suitable dielectric filler.

Figure 4:
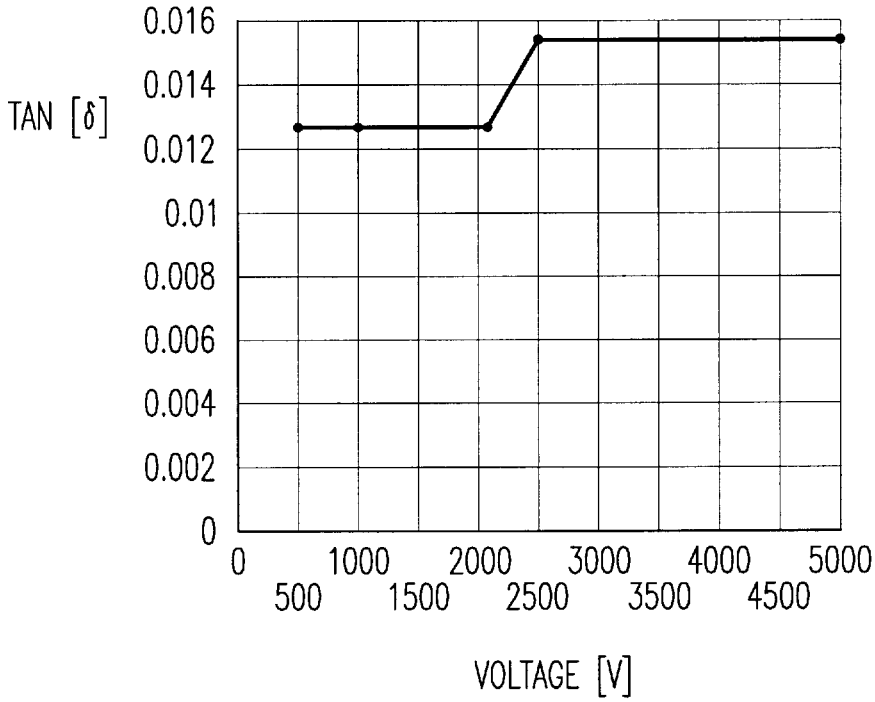
FIG. 4 is a graph illustrating the volume losses of the silicone-based composition in relation to the applied voltage.

Advantageously in the present embodiment of the invention, the dielectric filler is profitably made of a compressible silicone-based composition 4; in particular, the compressible silicone-based composition is injected inside the tube 1 in a liquid state and at larger amount than the allowed maximum volume by means of a suitable device, not illustrated in the figures. More precisely, V being the free volume to be filled, the injected compressible silicone-based composition has a volume ranging from 1.01 to 1.2 V, at a temperature of 25° C. Since the filler being injected is at liquid state, it fully saturates all the suitable volume; the injected silicone-based composition is then cured to a gel state. In this phase since the filler volume is larger than the volume V to be filled, a perfect adhesion of the silicone filler to all contact surfaces with the tube is facilitated. Considering the good compressible performance this also occurs when the device undergoes wide temperature variations, for instance, ranging from −40° C. to +70° C., without beakage, cracking or separation from the walls. Advantageously this allows dielectric strength levels of the device generally higher than those achievable by already known electric device and also a high dielectric strength value along said contact surfaces. The volume losses of the silicone gel behave as shown in the related graph (FIG. 4) where the dissipation factor tan $\delta$ is related to the voltage applied; moreover, tests pointed out that the values of dielectric constant $\epsilon$ (air related) ranges from 1,5 and 3.

Figure 5:
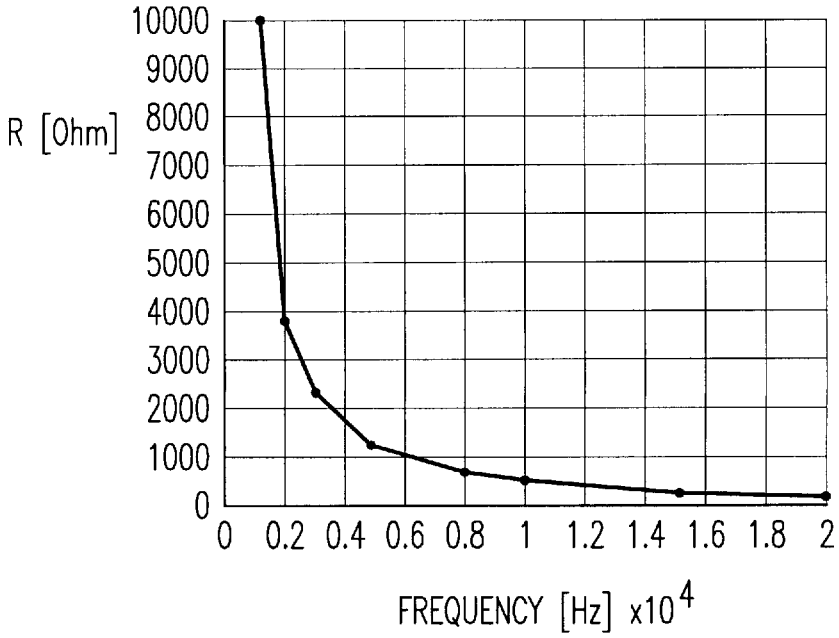
FIGS. 5 and 6 show, respectively, the behaviour of the electric equivalent R and C of the silicone-based composition employed in the electric device according to the invention.
Figure 6:
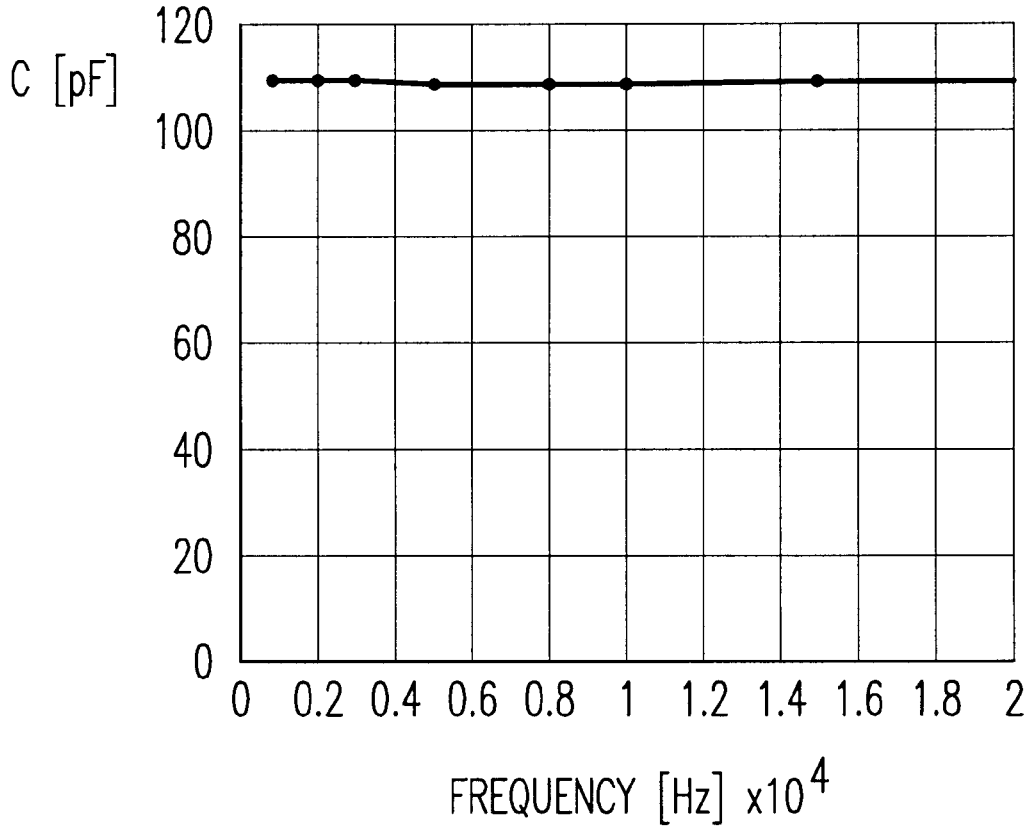

The electric equivalent circuit RC of such material is described in FIGS. 5 and 6 respectively.

In particular, in graph 5 it is easy to see how the equivalent resistance (Ohm), strongly decreases depending on frequency stress increasing (Hz); on the other hand, graph 6 easily points out how the equivalent capacity (pF), is substantially constant all over the tested frequency range.

A non limiting example of the silicone-based composition used is hereunder described.

A silicone gel-forming composition according to the present invention was prepared by mixing together the following organosilicon compounds (percentages are by weight unless otherwise indicated and viscosity is given for 25° C.):

75% dimethylvinyl—terminated polydimethylsiloxane, approx. 9000 $mm^2/s$;

20% dimethylvinyl—terminated polydimethylsiloxane, approx. 2000 $mm^2/s$;

0.75% trimethyl—terminated dimethylmethylhydrogensiloxane, approx. 5 $mm^2/s$;

4% (30.8 vol. %) Dualite M 6050 AE microspheres, approx. 70 $\mu$m diameter, and 0.1% Platinum-containing catalyst.

The silicone-gel forming composition had a viscosity of approssimately 17000 $mm^2/s$ and a specific gravity of 0.77 $g/cm^3$.

The silicone gel-forming composition was then cured at room temperature for 24 hours to give a silicone gel, having a penetration of 4 mm and a coefficient of thermal expansion of approssimatively 550 ppm/K.

Figure 3:
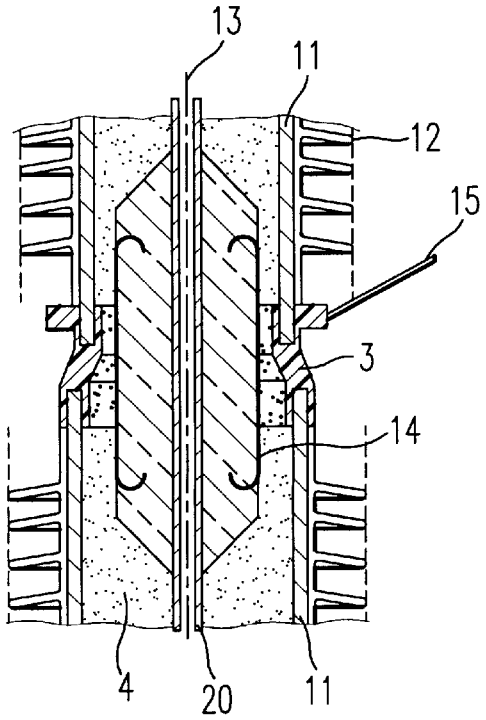
FIG. 3 shows in greater details a portion of the pole head illustrated in FIG. 2.
Figure 2:
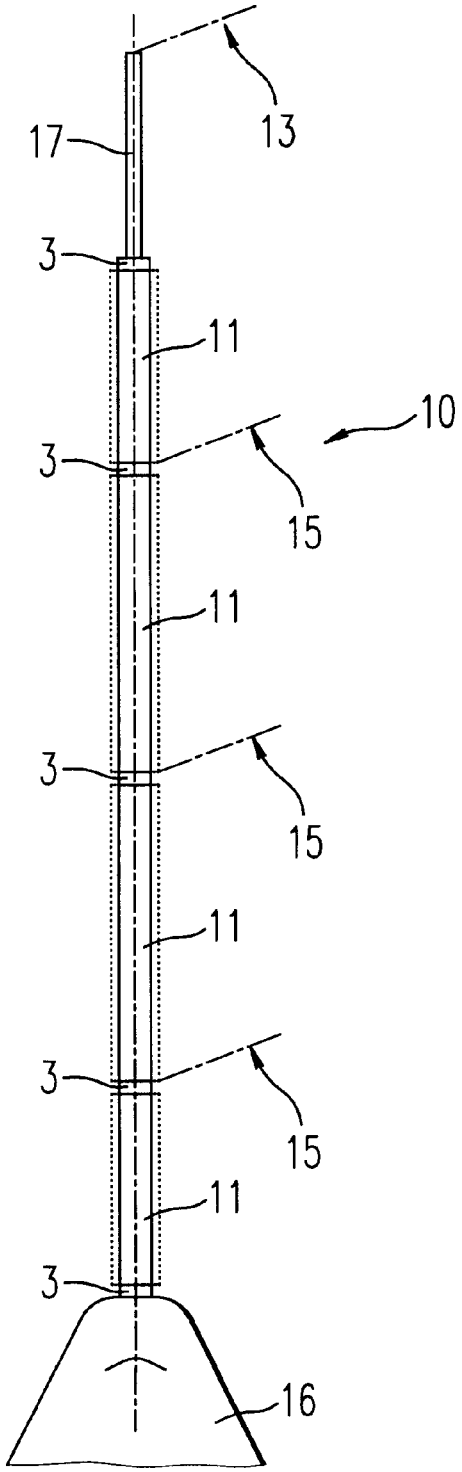
FIG. 2 shows a pole-head supporting aerial electrical lines, according to a second embodiment of the electric device of the present invention.

The gel can be advantageously used as insulating filler in several electric devices such as circuit breakers, insulated switch-gears, power and measuring transformers, surge arresters, cable terminations, pole heads, bushings, insulators and similar. In particular FIGS. 2 and 3 illustrate a pole-head 10 for supporting conductors and the like on poles for medium and high voltage transmission and/or distribution lines having as insulating filler the above described silicone-based composition. As illustrated in FIG. 2 the pole head 10 comprises a tubular portion formed by a plurality of tubular portions 11 made of insulating composite material, for instance fiberglass, and covered with insulating sheds 12, for example made of silicone rubber. As an alternative said tubolar portion can be formed monolithically with only one tubular portion. Tubular portions 11, which can have a cylindrical or conical shape, are connected to each other by means of coupling flanges 3, for example made of metallic material, which support electrical phase conductors 15. A conductive support 17, for example a metallic tube, supporting the ground wire 13 of the electrical line, is connected to the top of said tubular portions 11, and the whole pole head is connected to a supporting structure 16. In order to prevent electrical discharges among the parts of the pole head having a different voltage, the portions 11 are filled with the above described filler.

As shown in more details in FIG. 3, the ground wire 13, normally at zero potential, goes through the pole head structure; in this case, the ground wire 13 can be covered with at least one layer of insulating material 20, for example a cross-linked polyethilene (XLPE); the insulating layer cooperates with the silicone-based composition in insulating the ground wire from the parts of the pole head having a different voltage. In addition, the pole head comprises a plurality of silicone shields 14 arranged around the ground wire and mutually spaced along the axis of the pole head in correspondance of the flanges; the silicone shields are suitable to shield the electric field inside the pole head.

A pole-head as described in FIG. 2 was prepared using the above-described silicon composition. The total free-volume of the tubular portions 11 was 111.21 and was filled with 128.61 of the silicon composition using a suitable injection machine; the pressure of injection was 8 atm. The composition was then cured for 24 hours at 25° C. (room temperature).

The silicone-based composition was easily injected and filled entirely the available spaces; after curing, the obtained gel, thanks to its chemical-physical characteristics, perfectly adhered to all contact surfaces and its compressibility was even better than expected.

From the above description it is thus evident that the electric device of the present invention achieves the intended task and objects since it guarantees improved performances compared to already known electric devices, avoiding at the same time occurring of electric discharges; furthermore, the electric device thus conceived, can be used with wide temperature functioning ranges without requiring compensating volumes or surface treatments with adhesion promoters.

It must be pointed out that inside the electric device, functional elements, such as cables, mechanical rods, connections under voltage and so on, can be easily inserted; besides it is free of filler leakage problems and allows the elimination of monitoring and signalling systems of the leakage.

The invention thus conceived has been described with reference to particular and preferred embodiments, however it is not limited to what was described, but embraces the variants and modifications which fall within the scope of the inventive idea.

Finally all the details may be replaced by other technically equivalent elements.

What is claimed as new and desired to be secured be Letters Patent of the United States is:

1. An electric device for medium and high voltage lines, said device having a free volume V, comprising:

an insulating filler configured to fill said free volume V, wherein said insulating filler comprises a compressible silicone-based composition having a volume under normal conditions ranging from 1.01 to 1.2 V, at a temperature of 25° C.

2. The electric device according to claim 1, wherein said compressible silicone-based composition comprises hollow compressible microspheres.

3. The electric device according to claim 2, wherein said hollow compressible microspheres have diameters ranging from 50 $\mu$to 100 $\mu$m.

4. The electric device according to claim 3, wherein said hollow compressible microspheres comprise a plastic material.

5. The electric device according to any of the preceding claims wherein said compressible silicone-based composition comprises:

a) a crosslinkable polyorganosiloxane; and b) an organosilicon crosslinker.

6. An insulator for medium and high voltage lines comprising:

a tubular case made of insulating composite material and defining a free volume V;

insulating members protruding from said tubular case; and a compressible silicone-based composition configured to fill said free volume V and having a volume under normal conditions ranging from 1.01 to 1.2 V, at a temperature of 25° C.

7. A pole head for medium and high voltage lines comprising:

at least one tubular portion made of insulating composite material, said at least one tubular portion being fixed to a supporting structure and defining a free volume V;

insulating silicon members protruding from said at least one tubular portion;

a compressible silicone-based composition configured to fill said free volume V and having a volume under normal conditions ranging from 1.01 to 1.2 V, at a temperature of 25° C.; and coupling flanges configured to support line conductors connected to said at least one tubular portion and mutually spaced along an axis of said tubular portion.

8. The pole head according to claim 7, further comprising a plurality of insulating tubular portions connected to each other by coupling flanges and arranged so as to be mutually axially aligned.

9. The pole head according to claim 8, further comprising a conductive support fixed to one of said insulating tubular portions and configured to support a ground wire extending through the pole head and being covered by at least one layer of insulating material.

10. The pole head according to claim 9, wherein said at least one layer of insulating material comprises a cross-linked polyethilene (XLPE).

11. The pole head according to claim 7, further comprising a plurality of silicone shields arranged around the ground wire and mutually spaced along an axis of the pole head.

12. The insulator according to claim 6, wherein said compressible silicone-based composition comprises hollow compressible microspheres.

13. The insulator according to claim 12, wherein said hollow compressible microspheres have diameters ranging from 50 $\mu$ to 100 $\mu$m.

14. The insulator according to claim 12, wherein said hollow compressible microspheres are plastic microspheres.

15. The insulator according to claim 6, wherein said compressible silicone-based composition comprises:

a) a crosslinkable polyorganosiloxane; and b) an organosilicon crosslinker.

16. The pole head according to claim 8, further comprising a plurality of silicone shields arranged around the ground wire and mutually spaced along an axis of the pole head.

17. The pole head according to claim 9, further comprising a plurality of silicone shields arranged around the ground wire and mutually spaced along an axis of the pole head.

18. The pole head according to claim 10, further comprising a plurality of silicone shields arranged around the ground wire and mutually spaced along an axis of the pole head.

19. The pole head according to claim 7, wherein said compressible silicone-based composition comprises hollow compressible microspheres.

20. The pole head according to claim 7, wherein said compressible silicone-based composition comprises:

a) a crosslinkable polyorganosiloxane; and b) an organosilicon crosslinker.

* * * * *